United States Patent [19]

Kawabata et al.

[11] 4,380,472

[45] Apr. 19, 1983

[54] METHOD FOR PRODUCING PRESSURE PLATES USED IN HYDRAULIC PUMPS

[75] Inventors: Minoru Kawabata; Susumu Honaga, both of Aichi; Kenji Takahashi, Kariya, all of Japan

[73] Assignee: Toyoda Koki Kabushiki Kaisha, Kariya, Japan

[21] Appl. No.: 204,719

[22] Filed: Nov. 6, 1980

[30] Foreign Application Priority Data

Nov. 13, 1979 [JP] Japan ..... 54/147352

[51] Int. Cl.[3] ..... B22F 7/00

[52] U.S. Cl. ..... 419/9

[58] Field of Search ..... 75/208 R

[56] References Cited

U.S. PATENT DOCUMENTS 3,671,143 6/1972 Clark ..... 417/79

4,072,450 2/1978 Carlson ..... 418/133

*Primary Examiner*—James Poer

*Attorney, Agent, or Firm*—Oblon, Fisher, Spivak, McClelland & Maier

[57] ABSTRACT

Method for producing a pressure plate used in a hydraulic pump by connecting first and second plate sections together include the steps of pressing metal powders to individually form the first and second plate sections and a ring member into predetermined configurations, placing the first plate section properly on the second plate section while the ring member is inserted in a bore formed in the first plate section, placing brazing metal along the upper side diameter of the bore, and heating the first and second plate sections and the ring member so as to connect the first and second plate sections and the ring member together by the brazing metal and simultaneously sintering the same.

5 Claims, 5 Drawing Figures

METHOD FOR PRODUCING PRESSURE PLATES USED IN HYDRAULIC PUMPS

BACKGROUND OF THE INVENTION

1. Field of the Invention

The present invention relates to a method for producing a pressure plate used in a hydraulic pump, and more particularly to a method for producing a pressure plate used in a hydraulic pump by connecting two plate sections together.

2. Description of the Prior Art

In a conventional hydraulic pump having a pressure plate which includes two plate sections connected together, the pressure plate is provided with a plurality of ports through some of which fluid is sucked into expanding chambers of the hydraulic pump and through the rest of which fluid is discharged from chambers which are being compressed. Such a pressure plate is shown in FIGS. 1 and 2. A conventional method for producing the pressure plate employs the following steps. At first, a plate section 1A is formed with a pair of outlet ports 2 around which annular grooves 4 are formed on a side surface 3 of the plate section 1A and another plate section 1B is formed with a pair of ports 5. Next, the another plate section 1B is properly placed on the plate section 1A, while brazing metal 6 is put in the annular grooves 4 and, then, the assembled pressure plate including the plate sections 1A and 1B is heated in a heating furnace (not shown) under pressure, so that the brazing metal 6 is melted and is forced to spread on the side surface 3 to thereby connect the plate sections 1A and 1B together. However, in the pressure plate produced in the conventional method, leakage between the plate sections 1A and 1B may be caused, since the amount of the brazing metal 6 is limited due to the small area where the groove 4 is formed and cannot be supplied on the surface 3 so much as to prevent leakage. Furthermore, the plate sections 1A and 1B may suffer from distortion due to the pressure during the heating operation.

SUMMARY OF THE INVENTION

Accordingly, it is an object of the present invention to provide a new and improved method for producing a pressure plate used in a hydraulic pump by fluid-tightly connecting two plate sections together so as to prevent fluid leakage.

Another object of the present invention is to provide a new and improved method for producing a pressure plate used in a hydraulic pump, which pressure plate includes two plate sections and is formed by brazing and sintering in a single heating operation.

Briefly, according to the present invention, a method is provided for producing a pressure plate used in a hydraulic pump by fluid-tightly connecting first and second plate sections together, as mentioned below. Metal powders are first pressed so as to form the first and second plate sections and a ring member into predetermined configurations. The first and second plate sections are set in place, while the ring member is inserted in a bore formed in the first plate section so as to provide a fluid port in cooperation with a port formed in the second plate section. Brazing metal is placed along the upper side diameter of the bore. Finally, a heating operation is performed for fluid-tightly connecting the first and second plate sections and the ring member together by the brazing metal and for simultaneously sintering the same.

BRIEF DESCRIPTION OF THE DRAWINGS

Various other objects, features and attendant advantages of the present invention will be more readily appreciated as the same becomes better understood by reference to the following detailed description of a preferred embodiment when considered in connection with the accompanying drawings, wherein like reference numerals designate like or corresponding parts throughout the several views, and in which.

DETAILED DESCRIPTION OF THE PREFERRED EMBODIMENT

Figure 1:
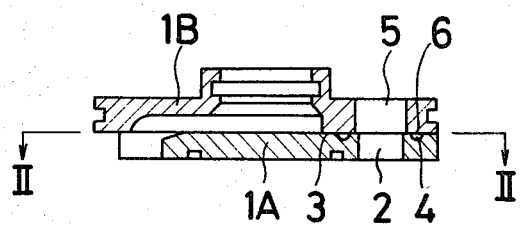
Fig. 1 PRIOR ART
FIG. 1 is a sectional view of a pressure plate produced in a conventional method, taken along the lines I—I of FIG. 2.
Figure 2:
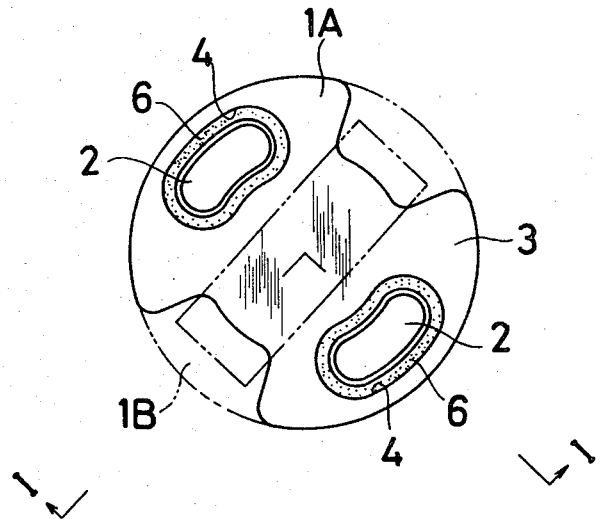
Fig. 2 PRIOR ART
FIG. 2 is a view taken along the lines II—II of FIG. 1, showing a surface of a plate section of the pressure plate.
Figure 3:
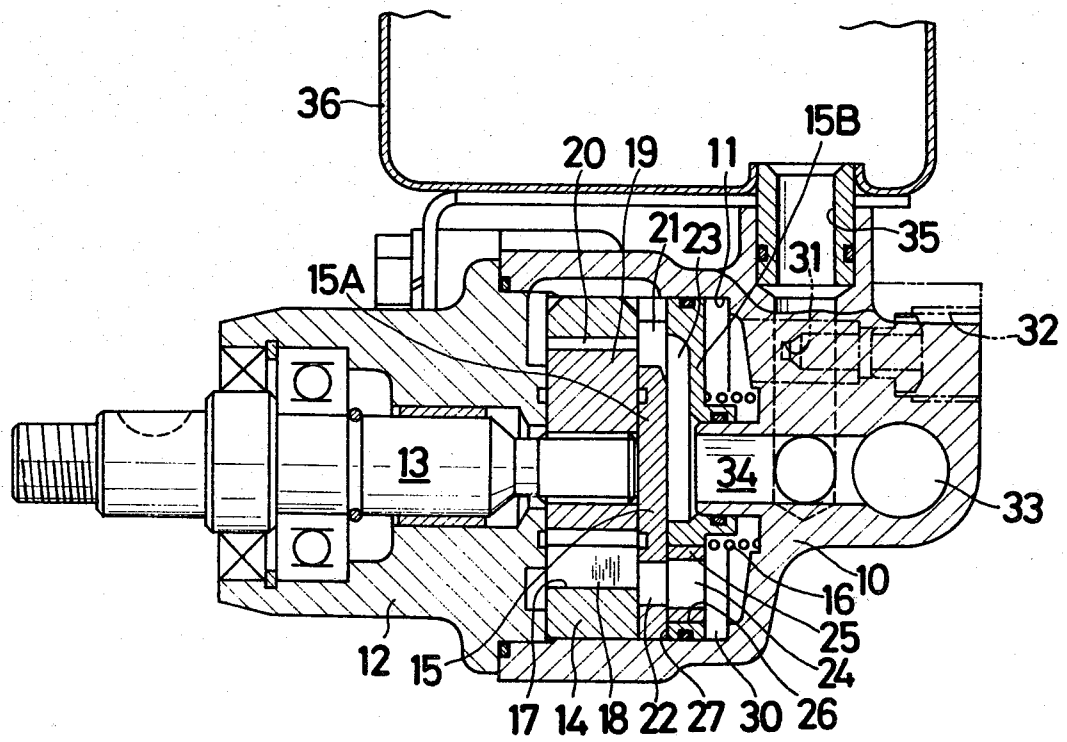
FIG. 3 is a longitudinal sectional view of a hydraulic pump which utilizes a pressure plate produced in accordance with the method of the present invention.

Referring now to the drawings and particularly to FIG. 3, reference numeral 10 denotes a pump body which is formed with a chamber 11. A support member 12 is secured to the open end of the pump body 10 and a rotor drive shaft 13 driven by an automotive engine (not shown) is rotatably carried by the support member 12. In the chamber 11, a cam ring 14 and a pressure plate 15 are slidably inserted and urged towards the support member 12 by a coil spring 16 inserted in the chamber 11. The cam ring 14 is formed with an internal cam surface 17 in which a pump rotor 19 is carried by the shaft 13 through a spline connection therewith. The pump rotor 19 carries a plurality of vanes 18 which are free to move radially in following the internal cam surface 17 so as to constitute a plurality of pump chambers 20 therebetween which are partitioned by the vanes 18. The pressure plate 15 is formed by connecting two plate sections 15A and 15B together in accordance with the method of the present invention. The plate section 15A which contacts the side of the cam ring 14 is formed with a pair of admission ports 21 and a pair of discharge ports 22. The plate section 15B is formed with a channel 23 and a pair of bores 26 in each of which a ring member 25 having a hole 24 is inserted. A pressure chamber 30 is defined as a portion of the chamber 11. The pump body 10 is provided with a bypass port 34 and a supply port 35 for supplying fluid from a reservoir 36 mounted on the hydraulic pump to the pump chambers 20 through the supply port 35, the bypass port 34, the channels 23 and the admission ports 21, and further with a port 32 and an orifice 31 for discharging pressurized fluid from the pump chambers 20 to the port 32 through the discharge ports 22, the hole 24, the pressure chamber 30 and the orifice 31. A spool valve 33 is provided in the pump body 10 for bypassing excessive flow from the pressure chamber 30 to the bypass port 34 in response to the pressure differential across the orifice 31 in a well known manner.

Figure 4:
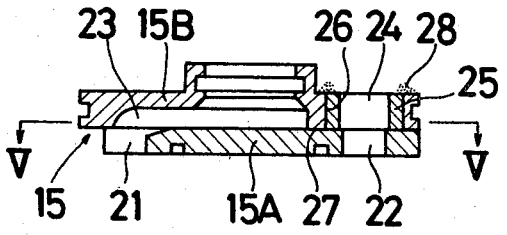
FIG. 4 is a sectional view of the pressure plate produced in accordance with the method of the present invention, taken along the lines IV—IV of FIG. 5.
Figure 5:
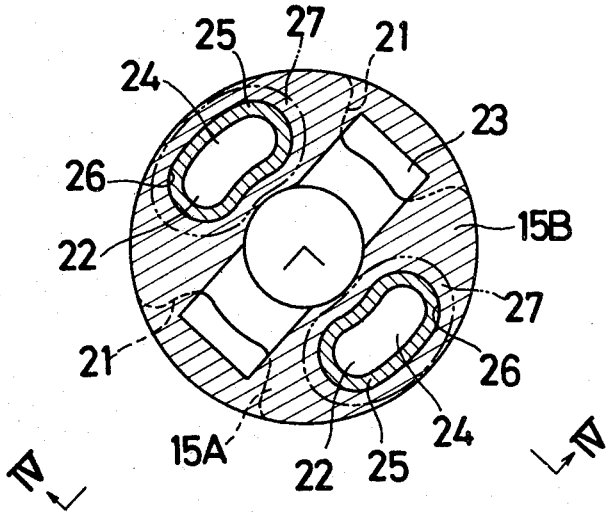
FIG. 5 is a sectional view taken along the lines V—V of FIG. 4.

The method according to the present invention for producing the pressure plate 15 is now described with reference to FIGS. 4 and 5. At first, each of the plate sections 15A and 15B and the ring member 25 is formed by pressing metal powders into its predetermined shape. The metal powders for producing the plate sections 15A and 15B and the ring member 25 consist of 96.5% of iron, 2.0% of copper, 0.5% of carbon and 1% of other materials. The metal powders are pressed until the density thereof becomes 6.4 to 6.8 g/cm$^3$ for press-forming each of the plate sections 15A and 15B and the ring member 25.

In the next step, the plate section 15B is properly set on the plate section 15A which is set horizontally and, then, the ring member 25 is inserted in the bore 26, wherein the diametetral clearance between the bore 26 and the ring member 25 is set from 0.05 to 0.1 mm so as to enable the melted brazing metal 28 to flow downwardly through the clearance during the subsequent heating operation. The diametral clearance is not limited to that range, but may vary depending upon various condition, such as, composition of the powdered metal or the brazing metal 26. Subsequently, powdered brazing metal 28 is placed along the upper side diameter of the bore 26 as shown in FIG. 4, and then, the assembled pressure plate 15 including the plate sections 15A and 15B and the ring member 25 is heated in a heating furnace for fluid-tightly connecting them together by the brazing metal 28 and for simultaneously sintering them. The powdered brazing metal is a nickel-base alloy including other materials, such as, manganese and copper. As the assembled pressure plate 15 is heated and the brazing metal 28 is melted, the liquid metal 28 flows downwardly into the diametral clearance between the bore 26 and the ring member 25 and further into a connecting area 27 between the plate sections 15A and 15B so as to fluid-tightly connect the plate sections 15A and 15B and the ring member 25 together and simultaneously sinter the same. The heating operation occurs at about 1,130° C. for about 20 minutes, but it may vary depending on the size and the composite materials of the plate sections 15A and 15B and the ring member 25. Accordingly, the assembled pressure plate 15 is fixedly and fluid-tightly connected together so as to prevent fluid leakage between the channel 23 and the discharge ports 22.

In the method of the present invention, it should be noted that the plate section 15A is connected to the plate section 15B by using the ring member 25. Accordingly, amount of the brazing metal 28 is not limited but can be freely controlled, so that the plate sections 15A and 15B at the connecting area 27 can be reliably connected with a sufficient amount of the brazing metal 28 to thereby prevent fluid leakage. Furthermore, since no pressure is applied to the plate sections 15A 15B during the heating operation, such are free from distortion.

Further, it should be noted that the brazing operation and the sintering operation are carried out in a single heating operation. Accordingly, production time can be reduced to that efficiency in production can be achieved.

In this embodiment, powdered brazing metal 28 is used, however, it should not be limited to powder since a ring-shaped brazing metal of, for example, 2 to 3 mm in thickness can also be used. Further, the brazing process is not limited to furnace brazing but other processes, such as, induction brazing can be used in the method of the present invention.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A method for producing a pressure plate used in a hydraulic pump by fluid-tightly connecting first and second plate sections together, utilizing a ring member having a hole formed therein wherein said first plate section has at least one bore formed therein and said second plate section has at least one port formed therein, which comprises:

pressing metal powders so as to form said first and second plate sections and said ring member into predetermined configurations;

setting said first and second plate sections in place and inserting said ring member in said at least one bore formed in said first plate section so as to provide a fluid port in cooperation with said at least one port formed in said second plate section;

placing brazing metal along an upper side diameter of said at least one bore; and heating said first and second plate sections and said ring member so as to be fluid-tightly connected together by said brazing metal and simultaneously sintering the same.

2. The method of claim 1, wherein said step of setting said first and second plate sections in place further comprises placing said first plate section properly on said second plate section and inserting said ring member in said at least one bore formed in said first plate section.

3. The method of claim 2, wherein said brazing metal further comprises nickel-base metal powders.

4. The method of claim 2, wherein said brazing metal further comprises a nickel-base metal having a ring-like shape.

5. The method of claim 2, which further comprises forming said first plate section with a pair of bores and a channel, forming said second plate section with a pair of first ports aligned with said channel and a pair of second ports, and forming said ring member with said hole for insertion in each of said pair of bores in said first plate section and in alignment with said pair of said second ports such that fluid can pass through said pressure plate via said channel, said pair of first ports, said pair of second ports and said hole formed in each said ring member.

* * * * *